US007258050B2

(12) United States Patent
Griffith

(10) Patent No.: US 7,258,050 B2
(45) Date of Patent: Aug. 21, 2007

(54) METHOD OF CUTTING SEGMENTED-END WEB

(75) Inventor: John Edwin Griffith, Swansea Heads (AU)

(73) Assignee: Turb-O-Web International Pty. Limited, Quakers Hill (AU)

( * ) Notice: Subject to any disclaimer, the term of this patent is extended or adjusted under 35 U.S.C. 154(b) by 0 days.

(21) Appl. No.: 10/953,504

(22) Filed: Sep. 30, 2004

(65) Prior Publication Data

US 2005/0150339 A1 Jul. 14, 2005

(30) Foreign Application Priority Data

Jan. 9, 2004 (AU) ..... 2004900109

(51) Int. Cl.
*B26D 1/03* (2006.01)
*B26D 3/02* (2006.01)

(52) U.S. Cl. ..... 83/49; 83/39; 83/36; 83/148; 414/360; 414/367

(58) Field of Classification Search ..... 83/34–36, 83/39, 471.1, 411.5, 404.3, 404, 225–231, 83/48, 49, 519, 418, 404.2, 636, 596; 144/360, 144/367, 1.1, 2.1, 3.1; 52/644
See application file for complete search history.

(56) References Cited

U.S. PATENT DOCUMENTS 2,983,289 A * 5/1961 McKinley ..... 83/471.2
3,229,732 A * 1/1966 Mayo ..... 83/404.1
3,538,963 A * 11/1970 Adams ..... 83/415
3,540,498 A * 11/1970 Thompson et al. ..... 83/471.1
3,543,815 A * 12/1970 Menge ..... 83/391
3,662,795 A * 5/1972 Heflin ..... 83/255
3,665,982 A * 5/1972 Kvalheim ..... 83/404.2
4,056,031 A * 11/1977 Thornton ..... 83/794
4,098,310 A * 7/1978 Sanford et al. ..... 144/402
4,277,998 A * 7/1981 Mayo ..... 83/404.1
4,770,076 A * 9/1988 Wilson ..... 83/75.5
5,022,297 A * 6/1991 Hommes et al. ..... 83/35
5,365,812 A * 11/1994 Harnden ..... 83/34
5,809,857 A * 9/1998 Owen ..... 83/404.1
5,934,164 A * 8/1999 Whatley, Jr. ..... 83/471.1
5,943,239 A * 8/1999 Shamblin et al. ..... 700/160
6,176,060 B1 1/2001 Kennelly et al.
6,249,972 B1 6/2001 Kennelly et al.
6,415,511 B1 7/2002 Kennelly et al.
6,688,067 B2 2/2004 Kennelly et al.

* cited by examiner

*Primary Examiner*—Boyer D. Ashley
*Assistant Examiner*—Laura M. Lee
(74) *Attorney, Agent, or Firm*—Nixon & Vanderhye P.C.

(57) ABSTRACT

A method of cutting an elongate timber web which forms on each of two opposed ends thereof a tapered end shape including a series of at least four cuts at successive angles to approximate an arcuate convex end. The method includes the steps of performing first and second passes of the web through a saw having cutter groups at adjustably spaced apart locations, each cutter group having at least two cutters (101, 102, 103, 104) set to angles so that the cutters of each cutter group correspond to a subset of said series of cuts (201, 202, 203, 204) at a respective end of the web. The web is rotated between the passes, the rotation between passes and the cutter settings together result in a multi-faceted end cut.

10 Claims, 4 Drawing Sheets

METHOD OF CUTTING SEGMENTED-END WEB

CROSS REFERENCE TO PRIORITY APPLICATION

The present application claims the benefit of Australian Application No. 2004900109 filed Jan. 9, 2004, incorporated by reference it its entirety.

BACKGROUND OF THE INVENTION

1. Field of the Invention

The present invention relates to a method of cutting segmented-end timber webs of the type used in manufacture of roof trusses by the "Turb-O-Web"™ method. In particular, the invention relates to a method of cutting the ends of a timber board with 4 or more cuts at each end so as to approximate a semi-circular end.

2. Description of the Art

The Turb-O-Web method of roof truss construction—which is the subject of U.S. Pat. Nos. 6,176,060, 6,249,972 6,415,511 and 6,688,067—offers substantial efficiency gains in the construction of oblique roof trusses for building construction, by adapting the truss construction to use webs having standardised tapered end shapes and, usually, also predetermined incremental lengths. The contents of those patents are incorporated herein by reference.

The preferred end shapes for the Turb-O-Web method are semicircular, or a segmented end shape which approximates a semicircle by a series of 4 or more (usually 5 or 7) straight cuts at successive angles.

The cutting of the end shapes of the webs in the Turb-O-Web method, whilst extremely efficient, has hitherto required the use of more specialised saws than those typically used for custom cutting the webs for conventionally-constructed trusses.

SUMMARY OF THE INVENTION

The present invention aims to provide a method of cutting a segmented web-end shape on both ends of a timber web for a wooden roof truss, which is adapted to be performed on a saw of the type often used for custom-cutting conventional webs.

Conventional saws of the type referred to are those such as the "Smartset"™ or "Smartset Pro"™ machines made by MiTek Industries, Inc. of Missouri, USA, and forerunners to those machines with less sophisticated electronic control. Such machines have a chain feed mechanism, which conveys the timber boards to be passed through the machine width wise, and on edge. There is a group of saws at each side of the chain, each group making cuts on one end of the board. Typically, there will be an alignment fence (or stop) and two saws on one end of the machine (often the left). The other end typically will have at least two saws, usually three.

There are many hundred, perhaps several thousand, units of this general type of machine in use in Australia and USA, and for those truss manufacturers not already in possession of a machine of this type they are readily available for purchase.

The method of the present invention will work best if the machine has a minimum of a length stop and two saws on one end, and three saws on the other end, but with some adjustment (as will be described later) the method may be adapted for machines with only two saws at the end opposite the length stop.

The present invention provides a method of cutting an elongate timber web so as to form on each of two opposed ends thereof a tapered end shape including a series of at least four cuts at successive angles to approximate an arcuate convex end, including the steps of:

providing a saw having first and second cutter groups at adjustably spaced apart locations, each cutter group having at least two cutters set to angles so that the cutters of each cutter group correspond to a subset of said series of cuts at a respective end of the web;

setting the relative spacing of said first and second cutter groups to set a desired web length to be cut;

performing a first pass of the web relative to the cutter groups whereby the cutters cut first subsets of the said series of cuts at said respective ends of the web;

rotating the web relative to the cutter groups following said first pass whilst maintaining the angles of the cutters; and performing a second pass of the web relative to the cutter groups to cut second subsets of said series of cuts at said respective ends of the web;

whereby said rotation of the web between said passes and the setting of said angles of said cutters in combination cause said first and second subsets of cuts to form on each end of the web said series of at least four cuts at successive angles to approximate an arcuate convex end.

Preferably, the web is rotated by 180° about either its longitudinal or transverse axes.

Preferably also, each said tapered end shape comprises a series of five cuts to approximate a semicircular end shape. Preferably the two end shapes of the web are substantially identical.

Preferably, on at least one end of the web said first and second subsets of cuts together with a pre-existing perpendicular end cut of the web form said series of cuts at successive angles to approximate an arcuate convex end.

BRIEF DESCRIPTION OF THE DRAWINGS

Further preferred embodiments of the invention will now be described with reference to the accompanying drawings, in which.

In each series of figures, FIG. A is the original board, FIG. B shows the cutting angles for the first pass, FIG. C is the board after the first pass, FIG. D shows the cutting details for the second pass, and FIG. E is the completed web. The figures are not to scale.

DETAILED DESCRIPTION OF THE PREFERRED EMBODIMENTS

The present embodiments are described with reference to four- and five-cut web end shapes, either at regular angles or at irregular angles as is described in the Applicant's co-pending patent application U.S. Pat. No. 10/878,484 filed on 29 Jun. 2004 (US Publication US-2005-0166522A1).

Figure 1A:
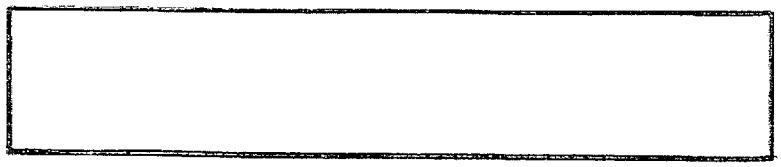
FIGS. 1A to 1E are a series of schematic elevations showing the steps of a first embodiment of the cutting method for cutting a five-cut segmented end shape.
Figure 1B:
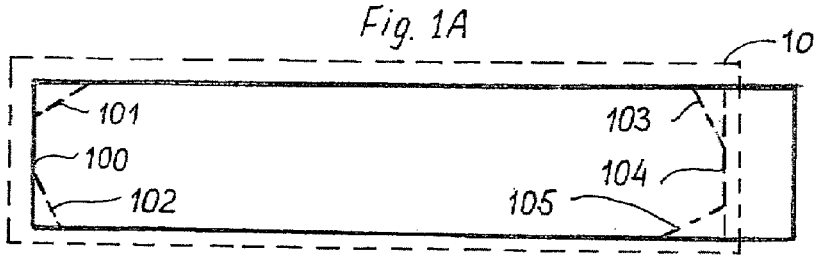

The first and second embodiments are also described with reference to use of a saw 10 (which is illustrated schematically in FIG. 1B) having a pair of cutter blades and a length stop at one end, and three blades at the other end, being a conventional prior art saw arrangement.

As described in the third and fourth embodiments, if a saw is to be used having only two blades at each end, a five-cut segmented end shape may be formed by performing a similar method with the additional step of cutting the web perpendicularly to the desired final length (FIGS. 4A to 4E). Alternatively, a four-cut segmented end shape may be formed without this additional step (FIGS. 3A to 3E).

With reference to FIGS. 1A to 1E, the original timber board from which the web is cut has parallel edges, is rectangular in cross-section and of the cross-sectional dimensions typically used for the construction of roof truss webs, eg. 70 mm by 35 mm for Australia or a nominal 2" by 4" board (1½" by 3½") for USA. The boards are in practice usually much longer than as shown schematically in the Figures, for example of sufficient length to cut a web length between 150 mm and 3600 mm as described in the method of U.S. Pat. No. 6,176,060.

At least one end of the board as provided by the timber supplier is usually square cut, but if it is not then it should be cut square prior to performing the method as described herein.

The board, or more usually, a batch of such boards lain side-by-side, is laid horizontally, usually on its narrow edge, on a conveyor device (not shown), so that the wider face (the front face visible in the Figures) is upright. The conveyor device is designed to convey the board horizontally towards the cutting blades of the cutter groups (not shown), ie. into the plane of the paper as shown in the elevational views.

At the left hand end of the board as shown, is a first cutter group with an end stop at line 100, and a pair of adjustable angle cutter blades at lines 101 and 102. The angles of the cutter blades are set so as to correspond to the angle of a fourth (102) and a first (101) cut from the top edge of the board as shown, in a series of five cuts to approximate a semicircular web end. The third cut 100 of the series is formed by the pre-existing perpendicular end of the board which abuts against the end stop.

In the Figures, the cutter blade or end stop angles are shown in broken lines and designated by '100 series' reference numerals 100 to 105, while the pre-existing web end facets and those cut by the blades are shown in solid lines and designated by the corresponding '200 series' numeral to the respective end stop or the blade which cut that facet. For example, end facet 204 has been cut by blade 104, while pre-existing end cut 200 corresponds to end stop 100.

The cutter group at the right hand end has three cutter blades, with a middle cutter blade set to cut at line 104 perpendicular to the board length to form the third cut of the series, and the other two cutter blades set to angles adapted to cut the second (103) and fifth (105) cuts at that end. The length of the web is the length between the two perpendicular ends 100, 104, and is set by adjusting the spacing between the right hand and left hand cutter groups.

Figure 1C:
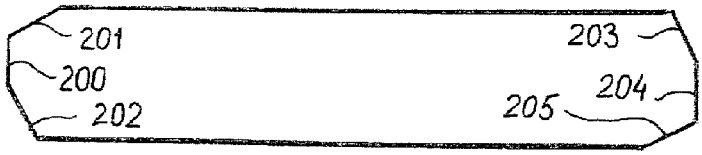
Figure 1D:
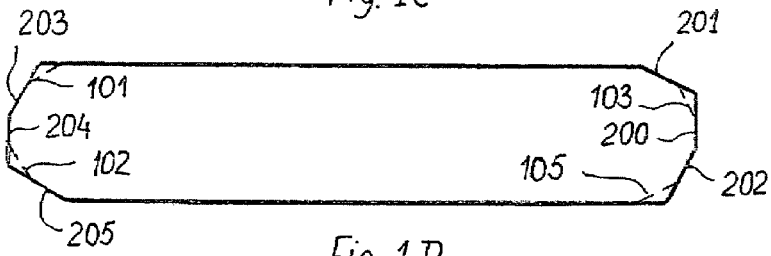

The board, or pack of boards, is moved past the cutter groups in a first pass, causing the blades 101 to 105 to cut the board to the shape shown in FIG. 1C.

The board, or pack of boards, is then flipped end-to-end by rotating about an axis perpendicular to the board and in the plane of the page, so that the end facets 203, 204 and 205 cut by respective of the right hand group of blades are now at the left end.

Figure 1E:
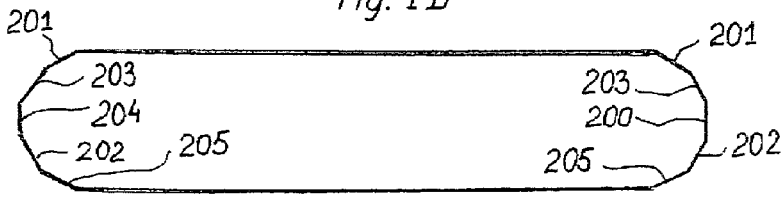
Figure 2A:
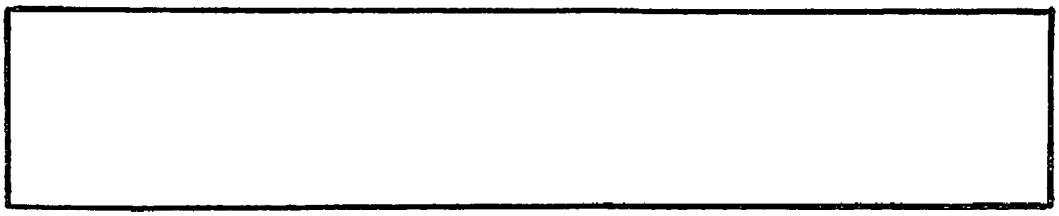
FIGS. 2A to 2E are a series of schematic elevations showing the steps of a second embodiment of the cutting method for cutting a five-cut segmented end shape.
Figure 2B:
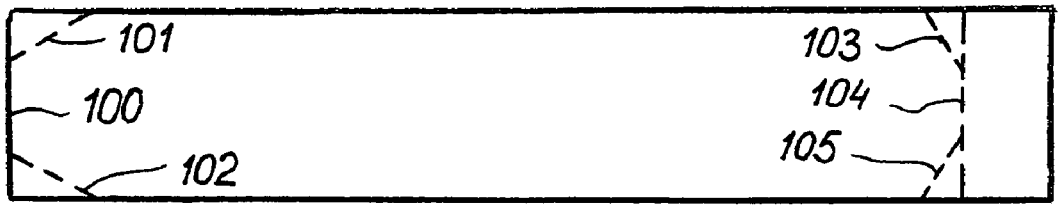
Figure 2C:
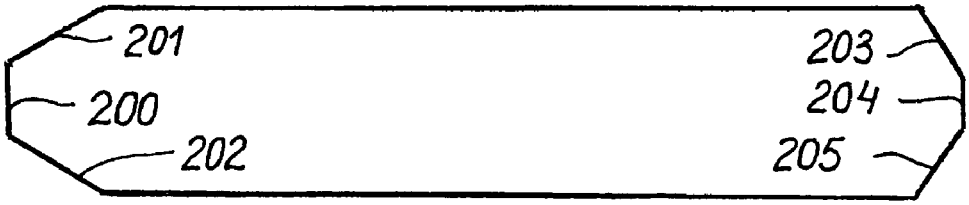
Figure 2D:
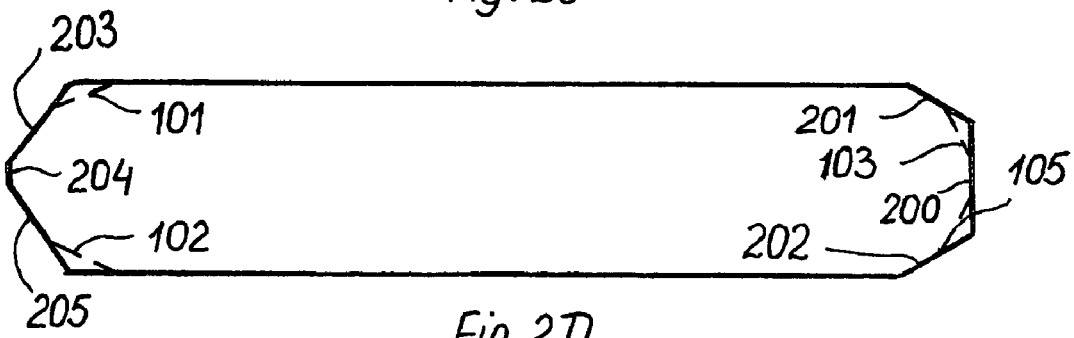
Figure 2E:
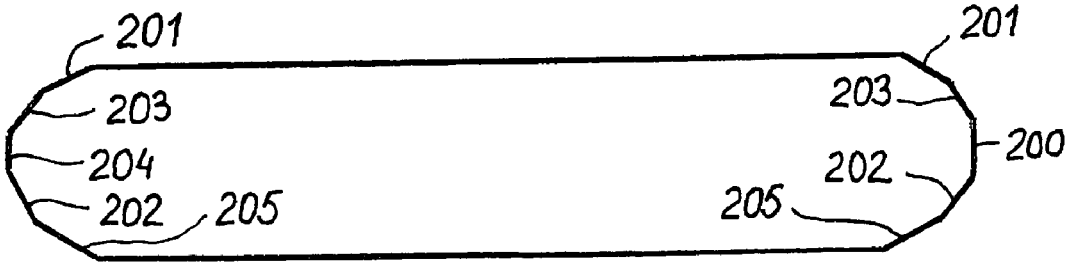

The board is then passed by the cutter groups a second time to result in the segmented web end shapes shown in FIG. 1E at both ends of the web.

Alternatively, the boards in FIG. 1A to 1E can be flipped top-to bottom (ie. rotated by 180° about its longitudinal axis), or by flipped end-to-end without inversion (ie. rotation by 180° about an axis perpendicular to the page) to achieve a similar end shape.

It can thus be seen how the five-cut segmented ends can be formed on the ends of the web using machinery adapted for a lesser number of cuts, with no adjustment of the cutter blade angles between passes. In order to cut webs of other lengths, for example the 150 mm standardised increments of the Turb-O-Web method or to cut special length webs, the operator may simply adjust the distance between the two cutter groups, again without the need to reset the cutter blade angles. In practice however, most truss manufacturing plants employing the Turb-O-Web system will be cutting the majority of its webs to the predetermined incremental lengths, so will typically be cutting large batches of identical webs at the one length before needing to reset the saw to cut different length webs.

The embodiment illustrated at FIGS. 2A to 2E is similar in principle to that described above, but with cutter blades 101 and 102 set to angle to form the first and fifth cuts, and blades 103 and 105 cutting the second and fourth cuts of the series. In this embodiment, between passes the board is flipped end-to-end either with or without inversion, ie. rotation by 180° about a transverse axis either perpendicular to or in the plane of the page as shown. An advantage of this arrangement over that of FIGS. 1A to 1E is that inversion of the board during the rotation step does not affect the final end shape, giving greater flexibility in the cutting procedure.

Other blade angle combinations, and numbers of blades, may be used to implement the present invention.

The embodiment of FIGS. 3A to 3E uses a four bladed saw (ie. two blades at each end and an end stop at the left side) to result in a four-cut segmented web end.

In this embodiment, the two cutter blades 1101, 1102 of the left hand cutter group are set to angles corresponding to the first 1201 and fourth 1202 facets of a four-cut end shape, and the two blades 1103, 1104 of the right hand cutter group are set to angles corresponding to the second 1203 and third 1204 facets.

Figure 3A:
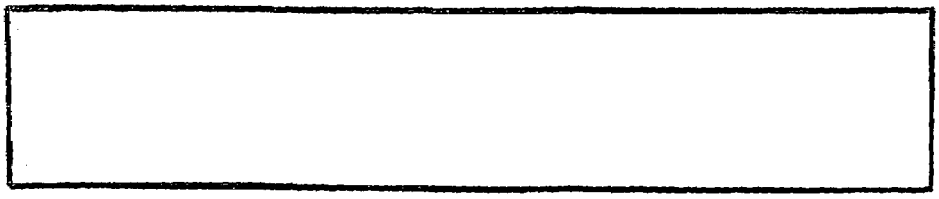
FIGS. 3A to 3E are a series of schematic elevations showing the steps of a third embodiment of the cutting method for cutting a four-cut segmented end shape with a four blade saw.
Figure 3B:
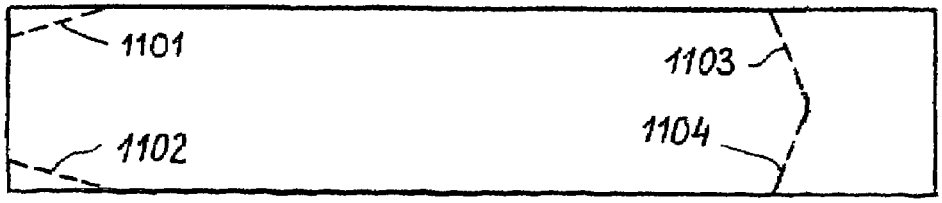
Figure 3C:
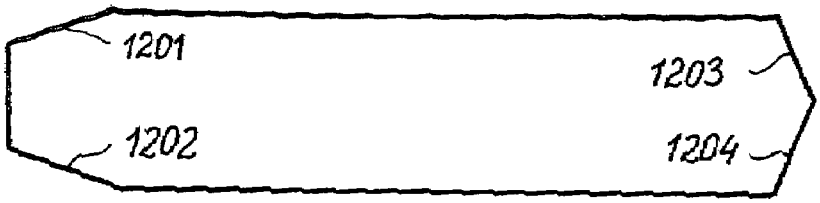
Figure 3D:
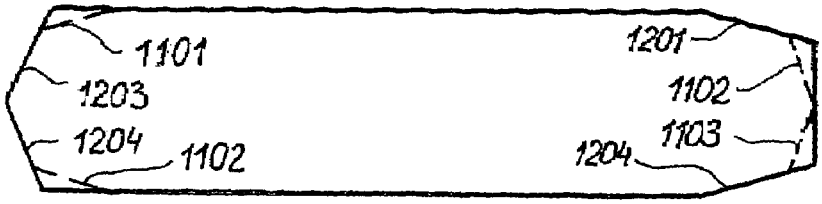

In the first pass (FIG. 3B), the original boards—which need not be pre-cut to the desired length—are cut to the shape shown in FIG. 3C.

Figure 3E:
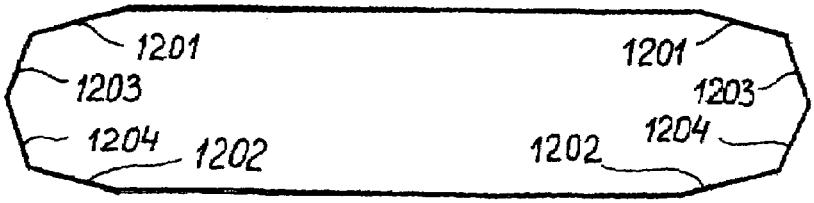
Figure 4A:
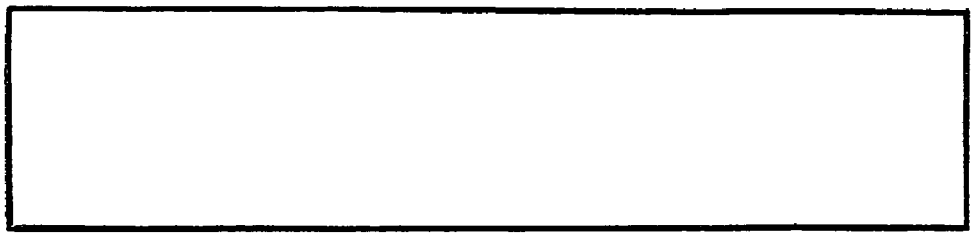
FIGS. 4A to 4E are a series of schematic elevations showing the steps of a fourth embodiment of the cutting method for cutting a five-cut segmented end shape with a four blade saw.
Figure 4B:
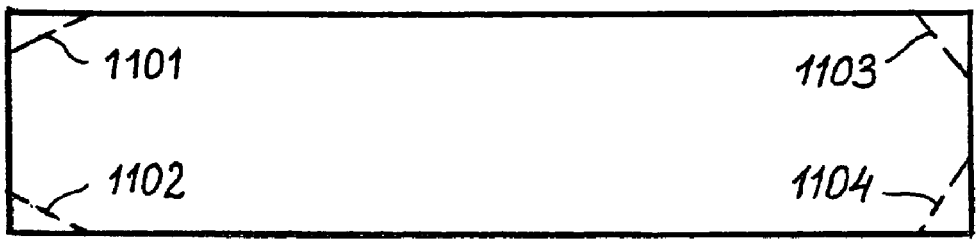
Figure 4C:
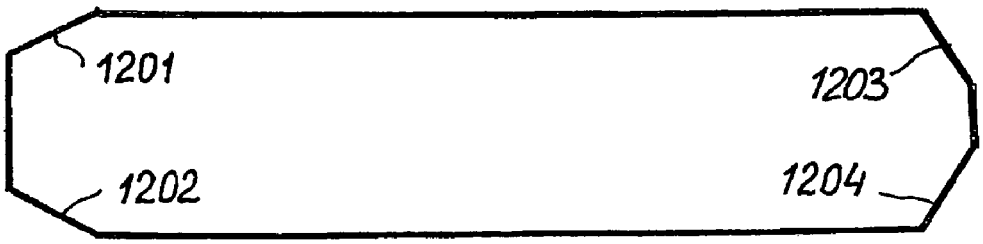
Figure 4D:
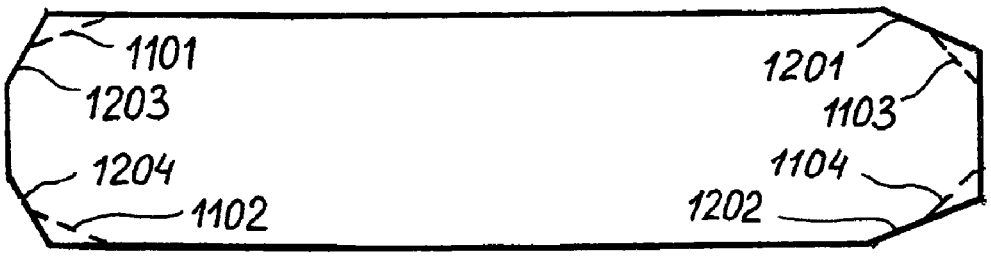
Figure 4E:
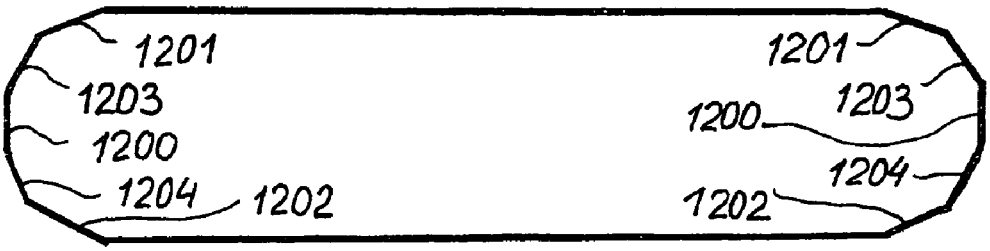

The boards are then flipped end to end, with or without inversion and the second pass (FIG. 3D) is performed to result in a web having the four-cut end shape shown in FIG. 3E.

FIGS. 4A to 4D show cutting of a five-cut segmented end shape using a the four blade saw used in the previous embodiment.

The original board (FIG. 4A) is first cut perpendicularly to the desired final length, before the first pass (FIG. 4B) in which blades 1101 and 1102 cut the first 1201 and fifth 1202 cuts of a five-cut end shape at one end and blades 1103 and 1104 cut the second 1203 and fourth 1204 cuts of a five-cut end shape are cut at the other end.

The board is then flipped end-for-end, with or without inversion, and passed through the saw for a second pass (FIG. 4D) to result in a five-cut end shape, in which the middle facets 1200 are the part of the perpendicular end faces of the board before the first pass.

In an unillustrated variation of the embodiment of FIGS. 4A to 4E, the perpendicular cut at one end may be performed between the passes. However, this is not preferred as in this embodiment it become necessary to select the correct end to trim, whereas when trimming to length before the first pass either end may be trimmed.

The present invention thus provides a relatively efficient method of cutting segmented web ends which, for the trade-off of a little extra handling of the webs compared to purpose-built segmented end saws, uses equipment which many truss manufacturers already have on site and hence requires little or no capital investment or staff retraining, and allows the truss manufacturer to commence web cutting for Turb-O-Web roof trusses without waiting for delivery of a more specialised saw. Even with the step of rotating the webs between passes, it is believed that the present method will still be considerably more efficient than the conventional prior art custom-cutting of web ends.

In the specification, the word "comprising" is understood in its "open" sense, that is, in the sense of "including", and thus not limited to its "closed" sense, that is the sense of "consisting only of". A corresponding meaning is to be attributed to the corresponding words "comprise, comprised and comprises where they appear.

While particular embodiments of this invention have been described, it will be evident to those skilled in the art that the present invention may be embodied in other specific forms without departing for the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein. It will further be understood that any reference herein to known prior art is commonly known by those skilled in the art to which the invention relates.

The invention claimed is:

1. A method of cutting an elongate timber web so as to form on each of two opposed ends thereof a tapered end shape including a series of at least four end cuts at successive angles to approximate an arcuate convex end, including the steps of:

providing a saw having first and second cutter groups at adjustably spaced apart locations, each cutter group having at least two cutters set to angles so that the cutters of each cutter group correspond to a subset of said series of cuts at a respective end of the web;

setting the relative spacing of said first cutter group from the second cutter group to set a desired web length to be cut;

performing a first pass of the web relative to both said cutter groups whereby the cutters cut first subsets of the said series of cuts at said respective ends of the web;

rotating the web relative to the cutter groups following said first pass whilst maintaining the angles of the cutters; and performing a second pass of the web relative to both said cutter groups to cut second subsets of said series of cuts at said respective ends of the web;

whereby said rotation of the web between said passes and the setting of said angles of said cutters in combination cause said first and second subsets of cuts to form on each end of the web said series of at least four cuts at successive angles to approximate an arcuate convex end.

2. A method according to claim 1 wherein each said tapered end shape comprises a series of five cuts to approximate a semicircular end shape.

3. A method according to claim 1 wherein the two end shapes of the web are substantially identical.

4. A method according to claim 1 wherein the elongate web has a longitudinal axis parallel to its length, and in the rotation step the web is rotated by 180° about its longitudinal axis.

5. A method according to claim 1 wherein the elongate web has a transverse axis perpendicular to its length, and in the rotation step the web is rotated by 180° about its transverse axis.

6. A method according to claim 2 wherein said first and second cutter groups of said saw each consist of two cutters.

7. A method according to claim 6 wherein said method further includes the step of cutting a perpendicular end cut on at least one said end of the web, said perpendicular end cut web forming with said first and second subsets of cuts said series of cuts at successive angles to approximate an arcuate convex end.

8. A method according to claim 2 wherein said one of said first and second cutter groups consists of two cutters and the other of said first and second cutter groups consists of three cutters.

9. A method according to claim 1 wherein said web prior to said first pass has at a substantially perpendicular end face at one end of the web, and wherein said perpendicular end face forms with said first and second subsets of cuts the series of cuts at successive angles on said one end of the web.

10. A method according to claim 9 wherein said web prior to said first pass has a further substantially perpendicular end face at an end of the web opposite said one end, and wherein said further perpendicular end face forms with said first and second subsets of cuts the series of cuts at successive angles on said opposite end of the web.

* * * * *